US005402914A

United States Patent [19]

Zapp

[11] Patent Number: 5,402,914

[45] Date of Patent: Apr. 4, 1995

[54] BEVERAGE DISPENSING DEVICE

[76] Inventor: Achim Zapp, 187 Rue Principale, F-57540 Petite Rosselle, France

[21] Appl. No.: 15,027

[22] Filed: Feb. 5, 1993

[51] Int. Cl.[6] ..... B67D 5/0; G09F 19/00

[52] U.S. Cl. ..... 222/78; 40/406

[58] Field of Search ..... 222/129.1–129.4, 222/23, 333, 78; 40/406, 407

[56] References Cited

U.S. PATENT DOCUMENTS

| | | | |
|---|---|---|---|
| 674,188 | 5/1901 | Schratz | 222/129.1 X |
| 1,024,515 | 4/1912 | Lippincott | 222/129.1 X |
| 1,487,816 | 3/1924 | Sintzel | 40/406 |
| 1,754,531 | 4/1930 | Stanford et al. | 40/406 X |
| 1,760,887 | 6/1930 | Sagman | 40/406 |
| 1,804,519 | 5/1931 | Smith et al. | 40/406 |
| 1,946,519 | 2/1934 | Bemis | 40/406 |
| 2,741,400 | 4/1956 | Hazzard | 222/130 |
| 3,123,255 | 3/1969 | Martin | 222/129.1 X |
| 3,261,506 | 7/1966 | Chenoweth | 222/129.1 X |
| 3,295,723 | 1/1967 | Welty | 222/129.1 X |
| 4,202,387 | 5/1980 | Upton | 222/23 X |
| 4,960,228 | 10/1990 | Takahashi et al. | 222/129.1 |
| 4,969,576 | 11/1990 | Merrill et al. | 222/129.1 X |

*Primary Examiner*—Andres Kashnikow
*Assistant Examiner*—Kenneth DeRosa
*Attorney, Agent, or Firm*—Edwin E. Greigg; Ronald E. Greigg

[57] ABSTRACT

A beverage dispensing device for spirits and syrups, having a metering device for metering the dispensed quantity of beverage, an outlet for the beverage to be dispensed, and a capped upside-down bottle of the beverage to be dispensed above the outlet, wherein to avoid sticking or plugging of the beverage lines, and to increase the dispensing speed, the upside-down bottle is submerged by its neck into a receptacle provided above the outlet, and wherein the outlet is connected via a beverage line to a reservoir that receives the beverage to be dispensed and which is not connected to the capped bottle above the outlet.

13 Claims, 2 Drawing Sheets

BEVERAGE DISPENSING DEVICE

Figure 1:
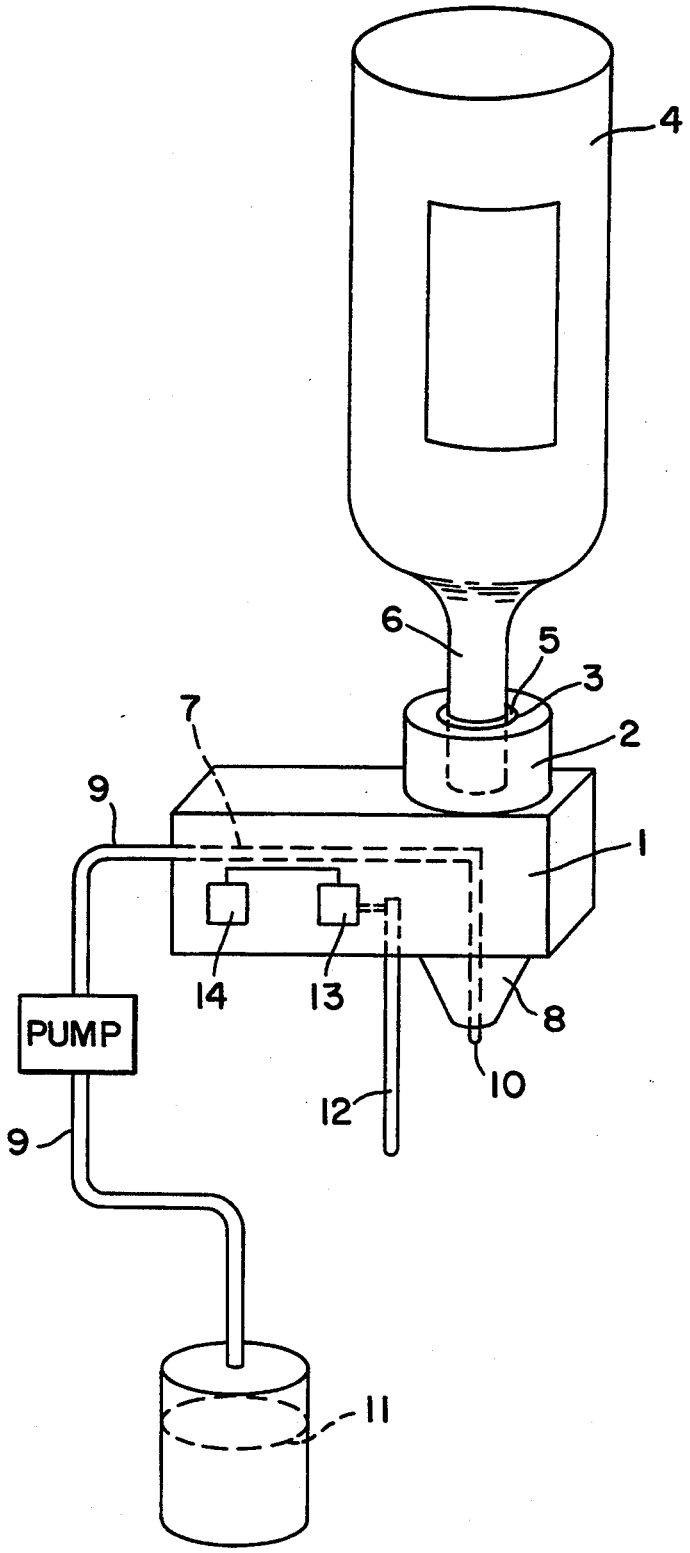

The invention is based on a beverage dispensing device as defined hereinafter.

Dispensing devices of this type, with an upside-down bottle, are used particularly for dispensing spirits and syrups; the upside-down dispenser is intended to indicate to the person filling it or his customer which beverage is to be dispensed. Recognition of the desired beverage is aided by the characteristic shape and makeup of the bottle.

Such known dispensing devices (German Utility Model 86 12 974) are usually equipped with a beverage-portioning device for dispensing a serving of the beverage, which is disposed at the opening of the bottle instead of a bottle top, and has a calibrated metering receptacle for receiving a predetermined serving of the beverage, into which a feeding channel discharges for a liquid-carrying connection with the bottle, and which has an outlet for delivering the serving of the beverage that is sealed by means of a valve which can be opened in the direction of the metering receptacle by the displacement of a mouthpiece of the outlet that protrudes downward.

These dispensing devices have the disadvantage that the liquid-carrying lines stick together because of the necessary entrance of air into the bottle, or become plugged by crystals. This occurs particularly with beverages with a high sugar content, such as syrups or liqueurs. A further disadvantage of these known dispensing devices is that, because the calibrated metering receptacle must be refilled, the filling time between each filling process is very long. Also, the outflow from the portion container into the vessel to be filled is slow because of the pressure, which is low when compared to compressed gas systems, for instance. Another disadvantage of these known dispensing devices that is not to be taken lightly is that the volume of the container receiving the beverage is low, resulting in frequent changing and a large amount of waste.

In contrast, the device in accordance with the invention, has an advantage that sticking or plugging of the beverage lines due to crystals is effectively avoided, and that the filling speed is significantly increased with respect to known dispensing devices; the advantages of the known dispensing devices of the generic type of the invention, namely the conspicuous identification of the dispensed beverage, are retained.

A further advantage of the dispensing device in accordance with the invention is that a beverage can be dispensed from arbitrary containers, so that the reservoirs need to be replaced less often, and the amount of waste is reduced. The reservoir for the beverage to be dispensed does not have to be disposed near the dispensing device, but can be located in a cool, theft-proof chamber of a cellar.

In an advantageous embodiment of the invention, the receptacle for the bottleneck completely covers at least the cap of the upside-down bottle. This embodiment has the advantage that the customer does not recognize that the bottle is capped, and that dispensing is effected from another container.

In another advantageous embodiment of the invention, rings of varying inside diameter can be placed into the receptacle to correspond to the varying outside diameter of the bottlenecks of different beverage bottles. This embodiment has the advantage that bottles of varying bottleneck diameters can be inserted into the receptacle of the dispensing device in accordance with the invention, so that one and the same dispensing device in accordance with the invention can be used for dispensing different types of beverages.

In another advantageous embodiment of the invention, an electric vibrating pump is disposed between the outlet of the dispensing device and the reservoir for supplying the beverage to be dispensed. Vibrating pumps of this type can generate pressures up to a maximum of 7 bar, thus overcoming large differences in elevation. Turning the pump on and off limits the dispensing process, so that metering can easily be effected via an electrical switch.

In another advantageous embodiment of the invention, a valve is provided that seals the outlet, as is a pneumatic pump that generates a constant pressure between the reservoir for the beverage to be dispensed and the valve. With this embodiment, the dispensing process is defined by the opening and closing of the valve that seals the outlet. This valve can also be embodied to be operated by an electrical switch. An advantage of this embodiment is that a plurality of dispensing devices can be kept at constant pressure by a single pneumatic pump.

In another advantageous embodiment of the invention, an electronic circuit activatable by a switch is provided that emits a signal for a pre-set time span to control the quantity of beverage supplied from the reservoir. By means of this electronic circuit, not only can the valve embodied as a magnet valve that is connected to a pneumatic pump be put into operation, but also an electrical vibrating pump for supplying a predetermined quantity of beverage for the same time span. Thus, by means of this electronic circuit, a metering of the dispensed quantity of beverage from the dispensing device in accordance with the invention is advantageously set in terms of serving size.

In a further advantageous feature of these characteristics, the number of control signals transmitted by the electronic circuit are saved in memory and displayed. The advantage of this embodiment is that the dispensed quantity of beverage can be controlled and read off at any time. This display can also be indicated in liters in accordance with an advantageous feature.

In another advantageous embodiment of the invention, the dispensing device is equipped with lever that can be operated by means of the vessel to be filled, and that operates the switch controlling the outlet. The advantage of this embodiment is that the dispensing device can be operated with one hand.

In a further advantageous feature of these characteristics, the lever is disposed laterally beneath the outlet of the dispensing device. This embodiment has the advantage that the lever can be operated by the side wall of the vessel to be filled. In the process the upper edge of a glass that the customer will put into his mouth, for example, is likewise prevented from coming into contact with the dispensing device. This is particularly advantageous from the standpoint of hygiene. The lever, because it operates an electric switch, not a valve, already reacts to slight pressure, so that only a small amount of force is needed to operate the dispensing device.

Further advantages and advantageous embodiments of the invention are to be taken from the following description, the drawings and the claims.

An exemplary embodiment of the subject of the invention is represented in the drawings and described below.

Figure 2:
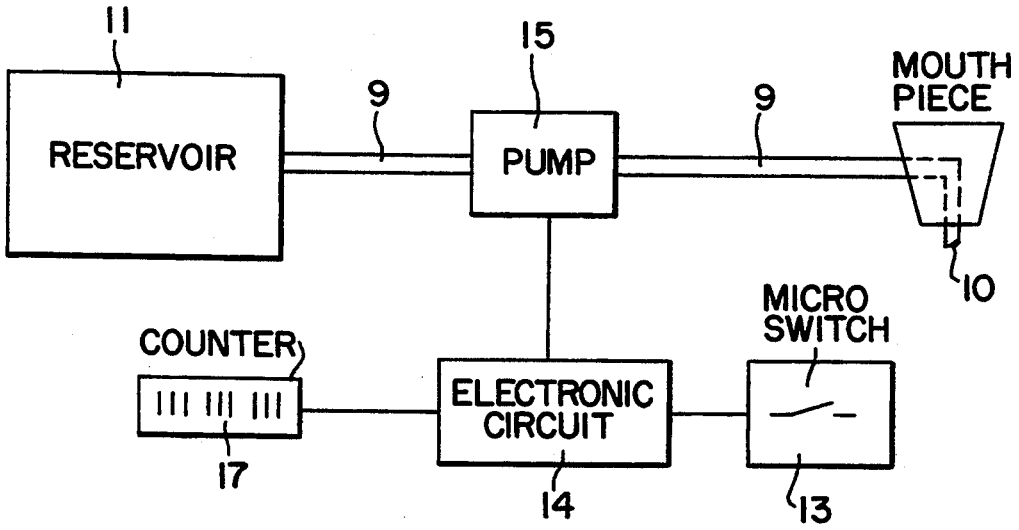
Figure 3:
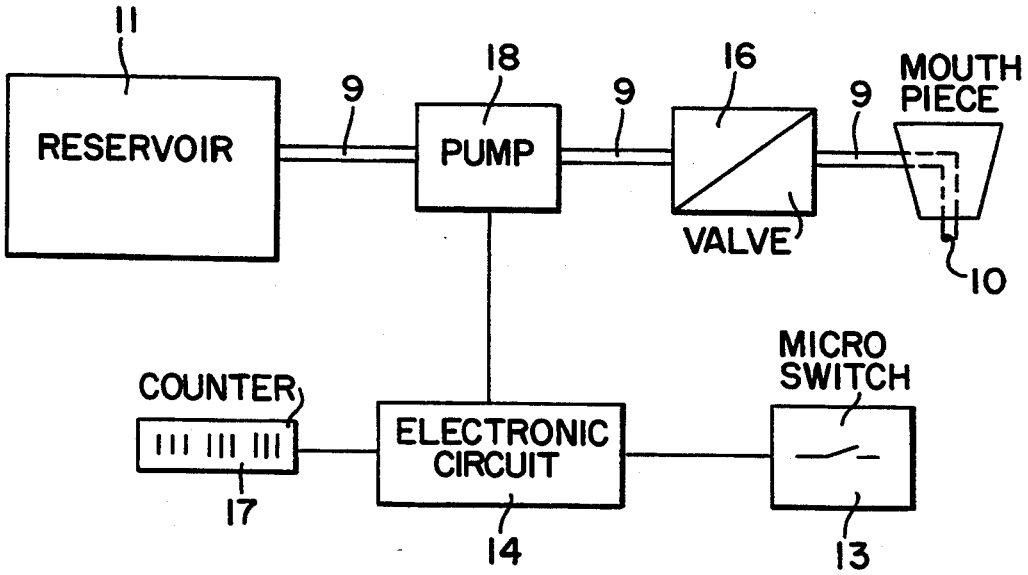

Shown are in:

FIG. 1 a view in perspective of a dispensing device in accordance with the invention;

FIG. 2 a schematic representation of a dispensing device in accordance with the invention, with an electric vibrating pump; and FIG. 3 a schematic representation of a dispensing device in accordance with the invention, with a pneumatic pump.

The dispensing device in accordance with the invention shown in FIG. 1 has a housing 1, which is provided on its upper side with a connector 2 that has a recess 3 that opens upwardly to receive a capped upside-down bottle 4 of a beverage to be dispensed from a separate reservoir of the beverage. A ring 5, preferably made of plastic, whose outside diameter corresponds to the inside diameter of the recess 3 and whose inside diameter corresponds to the outside diameter of the neck 6 of the bottle 4, is inserted into the recess 3. A recess 7 that angles downward is provided lengthwise through the housing 1 and discharges into an outlet connector 8. A beverage line 9 that likewise discharges into the outlet support 8 and is connected there with a mouthpiece 10 is guided through this recess 7. The beverage line 9 is extended on the other end, via a pump 15 or 18, to a reservoir 11, in which the beverage to be dispensed is stored. The reservoir 11 is not connected with the capped bottle 4. A lever 12 is pivotably supported in the housing, extends beyond the mouthpiece 10 of the outlet support 8 and emerges laterally next to the outlet connector 8. This lever 12 operates a microswitch 13, likewise disposed in the housing 1, that in turn activates an electronic circuit 14 for controlling the outflow from the dispensing device.

This electronic circuit 14 controls either an electric vibrating pump 15, as shown schematically in FIG. 2 between the reservoir 11 and the outlet mouthpiece 10, or an electrically controlled magnet valve 16, which is likewise disposed between the reservoir 11 and the outlet mouthpiece 10. In addition, the electrical circuit 14 sends a counting signal to a counter 17, which preferably converts the counting signals into liters of the dispensed beverage and displays them.

With the dispensing device shown in FIG. 3, the pressure in the beverage line 9 is held constant by means of a pneumatic pump 18 disposed between the reservoir and the magnet valve. For this purpose the pneumatic pump 18 has a so-called pressostat.

To dispense a specific quantity of beverage, with the dispensing device in accordance with the invention a vessel to be filled, such as a glass, is held under the mouthpiece 10 of the outlet connector 8 and, with the side wall of the vessel, the lever 12 is pivoted away from the mouthpiece 10. The microswitch 13 is activated by means of the pivoting of the lever 12 and, in turn, activates the electronic circuit 14. This electronic circuit 14 in turn sends a control signal to the electric vibrating pump 15 or the electrically controlled magnet valve 16 during a preset time interval, so that a predetermined quantity of the beverage is supplied. After the interval has ended, the vibrating pump 15 is shut down or the magnet valve 16 is closed. Each time the electronic circuit 14 is activated, it sends a counting signal on to the counter 17, which adds up these counting signals and displays them. By means of this, the dispensed quantity of beverage can be monitored at any given time. If the contents of the reservoir 11 are known, early recognition of when the tank is running out is possible.

It is to be noted that the bottle 4 is only for show and no beverage is dispensed from the bottle 4.

All of the features represented in the description, the subsequent claims and the drawing can be essential to the invention, either individually or in arbitrary combinations with one another.

I claim:

1. A beverage dispensing device for spirits and syrups, having a metering device for metering a dispensed quantity of a beverage from a reservoir, an outlet for the beverage to be dispensed, and a capped end of an upside-down bottle of the beverage to be dispensed is displayed above the outlet, said capped end of the upside-down bottle (4) includes a neck portion, said capped end neck portion is secured in a receptacle (3) provided above the outlet (8), said receptacle (3) completely covers the capped end of the upside-down bottle (4) and at least a portion of said neck portion and said receptacle (3) includes an adapter (5) comprising rings of varying inside diameters which is placed into the receptacle (3) to correspond to a variation in an outside diameter of the capped end portion of different beverage bottles (4), and that the outlet. (8) is connected via a beverage line (9) to said reservoir (11) from which the beverage is dispensed.

2. The dispensing device as defined by claim 1, in which an electric vibrating pump (15) for supplying the beverage to be dispensed is provided between the outlet (8) and the reservoir (11).

3. The dispensing device as defined by claim 2, in which the dispensing device is equipped with a lever (12) that is operated by the vessel to be filled and that operates a switch (13) that monitors the outflow.

4. The dispensing device as defined by claim 2, which includes an electronic circuit (14) that can be activated via a switch (13) that generates a time signal for controlling the quantities of beverage supplied from the reservoir (11).

5. The dispensing device as defined by claim 4, in which the dispensing device is equipped with a lever (12) that is operated by the vessel to be filled and that operates a switch (13) that monitors the outflow.

6. The dispensing device as defined by claim 4, in which the number of times the switch (13) is activated is stored in a memory and displayed via a display device (17).

7. The dispensing device as defined by claim 6, in which the display device (17) displays the dispensed quantity in liters.

8. The dispensing device as defined by claim 6, in which the dispensing device is equipped with a lever (12) that is operated by the vessel to be filled and that operates a switch (13) that monitors the outflow.

9. The dispensing device as defined by claim 1, which includes a valve (16) that seals the outlet (8) and a pneumatic pump (18) that generates a constant pressure in the beverage line (9).

10. The dispensing device as defined by claim 9, which includes an electronic circuit (14) that can be activated via a switch (13) that generates a time signal for controlling the quantities of beverage supplied from the reservoir (11).

11. The dispensing device as defined by claim 9, in which the dispensing device is equipped with a lever

(12) that is operated by the vessel to be filled and that operates a switch (13) that monitors the outflow.

12. The dispensing device as defined by claim 1, in which the dispensing device is equipped with a lever (12) that is operated by the vessel to be filled and that operates a switch (13) that monitors the outflow.

13. The dispensing device as defined by claim 12, in which the lever (12) is disposed laterally beneath the outlet 8 of the dispensing device.

* * * * *